United States Patent [19]

Nilson

[11] 3,952,926

[45] Apr. 27, 1976

[54] SELF-CLOSING CLOSURES

[76] Inventor: Billy Nilson, Finnstugaten 30,9500 Mjolby, Sweden

[22] Filed: Dec. 14, 1973

[21] Appl. No.: 424,919

[52] U.S. Cl. ..... 222/494

[51] Int. Cl.[2] ..... B65D 35/50

[58] Field of Search ..... 222/494, 556, 495, 496, 222/481.5, 481, 188, 211–213, 521, 525, 206, 514

[56] References Cited

UNITED STATES PATENTS

| | | | |
|---|---|---|---|
| 1,640,782 | 8/1927 | Lentz | 222/493 |
| 1,880,103 | 9/1932 | Murdoch | 222/494 |
| 1,905,936 | 4/1933 | Heard | 222/494 |
| 3,176,883 | 4/1965 | Davis, Jr. | 222/212 X |
| 3,656,660 | 4/1972 | Mueller | 222/212 X |
| 3,807,608 | 4/1974 | Nilsson | 222/521 |

FOREIGN PATENTS OR APPLICATIONS

| | | | |
|---|---|---|---|
| 724,798 | 2/1955 | United Kingdom | 222/496 |
| 1,441,112 | 4/1966 | France | 222/494 |
| 1,527,925 | 11/1969 | Germany | 222/494 |

*Primary Examiner*—Robert B. Reeves
*Assistant Examiner*—Norman L. Stack, Jr.
*Attorney, Agent, or Firm*—Ulle C. Linton

[57] ABSTRACT

A self-closing structure has a tube having a free end surrounded by a funnel shaped end of a cylinder supported on a diaphragm capable of being mounted on the open top of an elastically yielding container and upon compressing said container forcing the contents thereof against said diaphragm the funnel shaped end moves along said tube allowing said content to be extruded and upon the release of the container said funnel shaped end returns below said tube free end and is closed thereby. The release of the container due to its elastically creates a suction thereof drawing air down said tube into said container. A valve can be mounted below said tube normally closing the same, but being opened only for the suction in said container.

3 Claims, 6 Drawing Figures

SELF-CLOSING CLOSURES

Lately self-closing closures for bottles, tubes and the like have been developed comprising two parts displaceably mounted in relation to each other and connected to each other, one of these parts having a dispensing opening, normally held closed by means of a stem connected to the second part but which automatically opens upon the application of a pressure upon the contents of the package in order to dispense such contents. These closures have a number of advantages making them useful for most applications.

However, in certain applications it has been impossible to use them owing to the fact that the closure immediately provides sealing when the dispensing operation is terminated which means that air, which should replace the dispensed quantity cannot be sucked into the package. In plastic bottles for example the pressure upon the contents of the bottle is generated by applying a pressure upon the bottle for the deformation thereof, but this would result in a successive flattening of the bottle which in turn would make it impossible to store it in an up-right position.

Thus the primary object of the invention is to eliminate this drawback and to achieve this and other objects the invention is carried out according to the claims.

Figure 1:
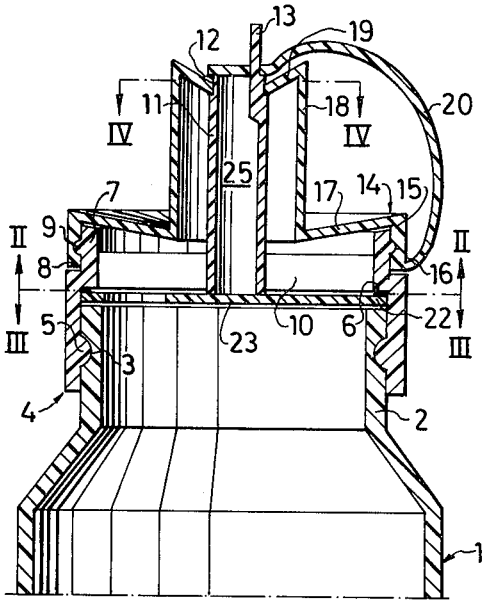
Figure 2:
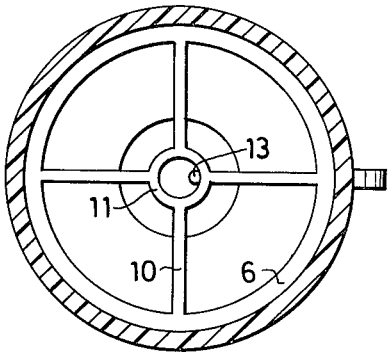
Figure 3:
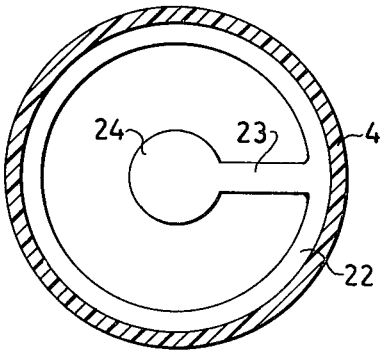
Figure 4:
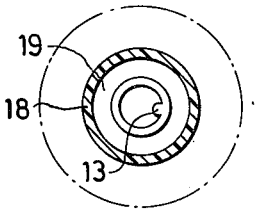
Figure 5:
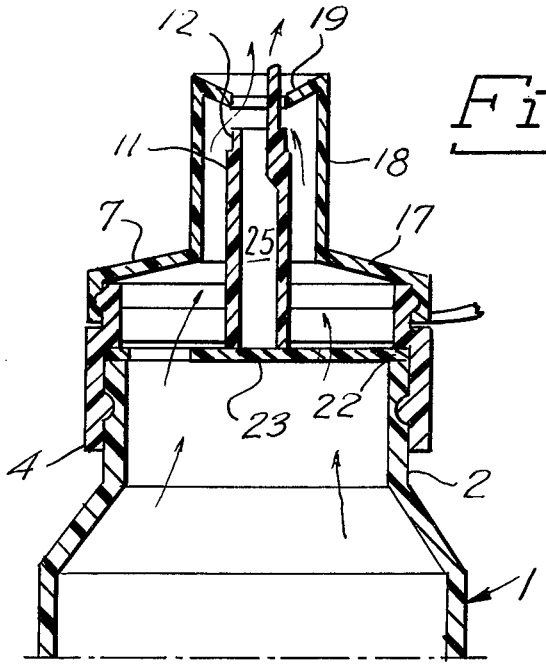
Figure 6:
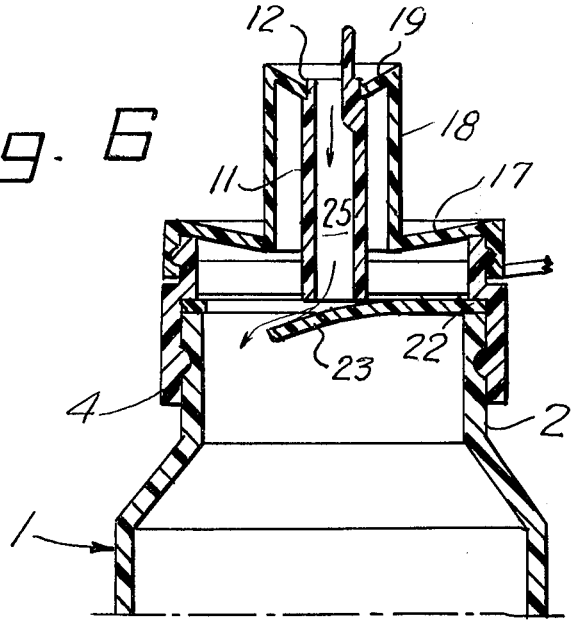

In the accompanying drawing an examplary embodiment of the invention is shown and FIG. 1 is a longitudinal section through the upper part of a bottle made from a plastic material and provided with the closure according to the invention, FIG. 2 is a section along line II — II in FIG. 1, FIG. 3 is a section along line III — III in FIG. 1, FIG. 4 is a section along line IV — IV in FIG. 1, FIG. 5 is a view similar to FIG. 1, but showing the closure in its discharge position, and, FIG. 6 is a view similar to FIG. 1, but showing the closure in its position when pressure upon the container has ceased. de In the drawing reference numeral 1 designates a bottle or a similar package made from a material having elastically yieldable characteristics, for example a plastic material having flexible properties corresponding to polyethylene, giving a high degree of deformability. The mouth portion of the bottle has in the FIG. the shape of a collar 2, which has a groove 3, a threading or the like for the connection of a cover or in this case a self-closing closure.

The self-closing closure according to the invention comprises a first member generally designated 4 and being shaped as a relatively rigid sleeve made from a plastic material and internally provided with a bead 5, a threading or the like to co-operate with a corresponding attachment part 3 of the bottle. The upper part of the sleeve has a reduced inner diameter and thus, there is defined between the two axial bores of the sleeve an annular inner flange 6 the purpose of which will be explained later. The upper part 7 of the sleeve has a reduced outer diameter and the sleeve will consequently also have an annular outer flange 8. This upper sleeve part has, as well as the bottle collar 2, an attachment portion, for example shaped as a circumferential bead 9. The sleeve communicates with a central part by means of a number of ribs 10 and a stem 11 projects axially from the central part said stem has a somewhat reduced diameter 12 in the free end thereof. As can be seen in the drawing the stem 11 is hollow and in manufacturing the member 4 which in this case is made by an injection moulding process — the inlet part 13 is not removed but projects from the interior of the stem and parallel to the longitudinal direction thereof.

The second member of the closure is generally designated 14 and comprises a sleeve shaped part 15 the interior of which is provided with an attachment part 15 such as a circumferential groove 16, which part is intended to co-operate with the attachment part 9 of the first mentioned member in order to secure these two members to each other along the outer circumference thereof. In the illustrated example incuding a groove and a bead, naturally, the securing is accomplished by pushing the members together causing the bead to snap into the groove. The sleeve-shaped part 15 of the second member merges into a diaphragm 17 that is slightly concave as seen from above and this diaphragm merges into an axially directed sleeve shaped member 18, which terminates in a funnel shaped end portion 19, the opening of which having approximately the same dimension as the free end 12 of the stem. A band or a tongue 20 which is very thin in relation to the length thereof also projects from the sleeveshaped part 15 and extends perpendicular to the longitudinal direction thereof. Said band or tongue may by the flexibility thereof be bent to occupy the position shown in FIG. 1. The tongue is provided with a thin hole through which the inlet part 13 may be inserted. By bending said inlet part or by means of heat deformation of it a simple and effective dismantable transportation seal is obtained.

Finally, the closure has a valve means which comprises an annular member 22 and a tongue 23 integral therewith and flexible and resilient radially extending therefrom and terminating in a circular portion 24. As appears from FIG. 1, the valve means is intended to be applicated between the end portion of the bottle mouth and the inner flange 6 of the first member 4. The annular member 22 has such a thickness that it will be securely pressed between these parts. By means of the radially extending resilient tongue 23 the portion 24 thereof will normally be in engagement with the lower side of the centrally mounted stem and biased thereagainst thereof independant of the angular position of the valve means.

The described closure functions in the following manner:

When the transportation seal has been opened by releasing the connection between the tongue and the inlet part 13 by pulling the tongue the closure is ready for use. When it is desired to dispense some of the contents of the bottle a slightly squeezing action is performed on the bottle while the bottle is kept with the mouth thereof directed towards the place where it is desired to have the dispensing accomplished. By the pressure exerted upon the material contained in the bottle the diaphragm 17 will be raised as shown in FIG. 5 so that the opening of the funnel shaped end will leave the stem 11. As the contents of the bottle may pass freely from the bottle into this sleeve shaped part a certain amount of said content will consequently be dispensed through the annular opening that is now defined between the sleeve shaped member 18 and the stem 11, 12. During this dispensing action the central part 24 of the tongue 23 serving as a valve has been maintained in sealing contact with the lower part of the stem. As soon as the pressure on the bottle is released the diaphragm 17 returns to its original position as shown in FIG. 6. Sealing again occurs between the stem 11, 12 and the end portion 19 of the sleeve shaped member 18. Thus, the different components of the closure return to the original position as shown in FIG. 1 but before this position is reached the valve 22 – 24 has opened as a result of the resulting suction and air consequently is sucked into the container through the passage 25 in the stem 11. As soon as the equilibrium point is reached also the valve returns to its original position shown in FIG. 1 in which it sealingly engages the lower edge of the stem and thus prevents any further air exchange through the passage 25.

It will be understood that the closure now described may be mass produced at low costs due to the simple structure thereof and that it may be easily applicated to bottles, jars and the like of the type mentioned. The funnel shape of the end wall of the sleeve shaped member 18 permits that the exterior of said wall is kept clean since any rests of the dispensed material adhering to the cloure will tend to stream down into the bowl so defined by the storage of the bottle in the up-right position and will be sucked into the container together with the air. The fact that the stem is hollow results — besides from the mentioned advantage that air and surplus material may be sucked into the package in that the dispensed string material is cut off rather than pulled to break. In the latter case the surface tension forces would result in a drop or a film adhering to the closure.

Naturally, the closure may be made from a plastic material with pronounced yielding characteristics but by making the diaphragm thin enough it is possible to manufacture it from a substantially rigid material and especially when the transportation sealing tongue 20 is omitted. When a transportation seal is desired this becomes very inexpensive since the removal of the inlet part from the moulded piece is omitted.

It may be noted that the extension 12 of stem has been illustrated as projecting a certain distance above the adjacent part of the wall 19 but in practice the end of extension 12 is practically flush with the upper inner part of wall 19.

I claim:

1. A self-closing closure comprising a first member and a second member, said members being mutually connected along their outer portions, said first member having extending from said outer portion a flexible and resilient diaphragm portion having a centrally disposed discharge opening and said second member having a centrally located, axially extending stem, said stem being connected to the outer portion of said second member by means of rib like elements, one end of said stem being adapted to seal position discharge opening of said diaphragm portion in the initial possition of said members, said members being adapted to be connected to a squeezable container such that a pressure exerted upon the content of said container, preferably by exerting a manual pressure upon said container, will enable said diaphragm to raise into an active position in which said discharge opening is free of said stem causing a dispensing of the content from said container through said discharge opening, said diaphragm returning by means of its resilient bias to its initial position when said pressure ceases, said stem having an air passage axially extending from said end formed therethrough, said air passage forming a communication between the atmosphere and the interior of said container, a valve means being adapted to normally contact with a resilient bias the opposite end of said stem to seal the air passage thereof, the bias of said valve means being however insufficient to hold said valve means in contact with said opposite end of said stem when the pressure in said container is below a predetermined value lower than the atmospheric pressure thereby enabling air to be sucked into said container through said air passage in said stem, the first mentioned end of said stem being adapted not to axially project over the upper surface of said diaphragm portion surrounding it and said air passage being calibrated to allow fluid of the kind contained in said container to flow therethrough thereby enabling excess fluid from the discharge process to be re-sucked into the container simultaneously with the sucking in of air.

2. A self-closing closure as claimed in claim 1 wherein said valve means is made from a flexible and resilient material and comprises an annular portion adapted to be guided and secured by at least one of said members of the closure and a tongue integral with said annular portion and extending radially therefrom and ending in a central portion which in the initial position of the closure parts seals the air passage of said stem.

3. A self-closing closure as claimed in claim 1, wherein said diaphragm portion of said first member in the central portion thereof has a sleeve-like portion having an end wall, the discharge opening being provided in said end wall, said end wall being inclined such that its inner portion is located at a lower level than its outer portion, the first-mentioned end of said stem being always located below the upper part of said end portion.

* * * * *